United States Patent [19]

Schroeder, Jr. et al.

[11] Patent Number: 4,932,474

[45] Date of Patent: Jun. 12, 1990

[54] STAGED SCREEN ASSEMBLY FOR GRAVEL PACKING

[75] Inventors: Donald E. Schroeder, Jr., Littleton, Colo.; Bradley D. Hutchison, Lafayette, La.

[73] Assignee: Marathon Oil Company, Findlay, Ohio

[21] Appl. No.: 219,111

[22] Filed: Jul. 14, 1988

[51] Int. Cl.[5] ..... E21B 43/04

[52] U.S. Cl. ..... 166/278; 166/51; 166/242; 166/296; 166/317; 166/376

[58] Field of Search ..... 166/276, 278, 51, 142, 166/185, 317, 319, 320, 242, 296, 376, 386

[56] References Cited

U.S. PATENT DOCUMENTS

| | | | |
|---|---|---|---|
| 2,419,313 | 4/1947 | Byrd | 166/296 X |
| 3,216,497 | 11/1965 | Howard et al. | 166/19 |
| 3,273,641 | 9/1966 | Bourne | 166/278 X |
| 3,277,962 | 10/1966 | Flickinger et al. | 166/278 |
| 3,333,635 | 8/1967 | Crawford | 166/296 X |
| 3,358,770 | 12/1967 | Zandmer | 166/317 |
| 3,880,233 | 4/1975 | Muecke et al. | 166/296 X |
| 3,884,301 | 5/1975 | Turner et al. | 166/278 |
| 3,999,608 | 12/1976 | Smith | 166/51 X |
| 4,018,282 | 4/1977 | Graham et al. | 166/278 |
| 4,018,283 | 4/1977 | Watkins | 166/278 |
| 4,046,198 | 9/1977 | Gruesbeck et al. | 166/278 |
| 4,350,203 | 9/1982 | Widmyer | 166/51 |
| 4,428,431 | 1/1984 | Landry et al. | 166/298 |
| 4,438,815 | 3/1984 | Elson et al. | 166/278 |
| 4,522,264 | 6/1985 | McNeer | 166/278 |
| 4,609,005 | 9/1986 | Upchurch | 166/317 X |
| 4,733,723 | 3/1988 | Callegari, Sr. | 166/51 |

OTHER PUBLICATIONS

T. E. Zaleski, Jr. and E. Spatz, "Horizontal completions challenge for industry", Oil and Gas Journal, May 2, 1988, pp. 58, 62, 64, 67, 68 and 70.

*Primary Examiner*—Hoang C. Dang

*Attorney, Agent, or Firm*—Jack L. Hummel; Jack E. Ebel

[57] ABSTRACT

A gravel packing process employs a staged screen assembly to prevent sand and other fine particles entrained in the produced hydrocarbon fluids from entering the production tubing and related equipment. The staged screen assembly is provided with a base pipe having rupture disks in its sidewall. The disks rupture at a predetermined pressure differential during gravel packing to enable leakoff of the carrier fluid from the gravel slurry into the base pipe and recirculation of the carrier fluid back to the wellhead, while ensuring complete and uniform gravel packing of the hydrocarbon production interval without substantial bridging or duning.

19 Claims, 2 Drawing Sheets

STAGED SCREEN ASSEMBLY FOR GRAVEL PACKING

BACKGROUND OF THE INVENTION

1. Technical Field

The invention relates to an apparatus and process for trapping fine particles entrained in hydrocarbon fluids produced from an unconsolidated hydrocarbon-bearing formation and more particularly to an apparatus and process for gravel packing a wellbore in fluid communication with an unconsolidated hydrocarbon-bearing formation.

2. Background Information

A hydrocarbon production well in fluid communication with an unconsolidated formation is typically completed by casing the wellbore, cementing the casing, and perforating the well at spaced intervals down the length of the production zone. Without further steps, formation fluids produced into the wellbore can entrain fine particles such as sand. The presence of fine particles in the produced fluids presents operational problems for the wellbore tubing and other production equipment. Furthermore, if sand is allowed to wash out from behind the casing, the washed out sections of the wellbore can cave and subsequently collapse the casing.

Gravel packing is a method of trapping entrained sand and other fine particles before the formation fluids enter the production string. Many gravel packing methods exist in the art as exhibited by the following list of U.S. Pat. Nos.:

| | |
|---|---|
| 3,216,497 | Howard et al |
| 3,884,301 | Turner et al |
| 4,018,282 | Graham et al |
| 4,018,283 | Watkins |
| 4,046,198 | Gruesbeck et al |
| 4,350,203 | Widmyer |
| 4,428,431 | Landry et al |
| 4,438,815 | Elson et al |
| 4,522,264 | McNeer |

U.S. Pat. No. 4,018,283 to Watkins exemplifies a circulating gravel packing process. In general, a circulating gravel packing process places a tubing string terminating in a perforated base pipe into a wellbore. The base pipe extends concentrically through the wellbore down the length of the production zone. The base pipe defines an annulus in the wellbore between it and the production zone.

The gravel pack is performed by injecting a slurry containing gravel and a carrier fluid into this annulus. The gravel accumulates in the annulus while the carrier fluid leaks off through a screen into the base pipe and circulates back to the wellhead. Gravel packing is continued until the entire annulus adjacent the production zone is filled with gravel.

An optimum gravel pack is uniformly packed throughout the annulus. If the gravel pack contains non-uniformities, produced fluids carrying fine particles can channel through the gravel pack and into the production tubing. This defeats the filtering function of the gravel pack.

Circulating gravel packing processes continually confront the problem of bridging, duning and the formation of other non-uniformities, especially in wellbores deviating from the vertical. The upper end of a conventional base pipe often diverts the carrier fluid from the annulus before the slurry reaches the lower end of the annulus. Gravel prematurely builds up at the point of leakoff which creates a bridge in the upper annulus and a void in the lower annulus.

A circulating gravel packing apparatus and process are needed which enable proper leak off of the carrier fluid and which enable uniform gravel packing across the entire length of the annulus between the wellbore wall and the base pipe adjacent the production zone. An effective gravel packing apparatus and process are needed for highly deviated wells where the problem of bridging and duning is particularly acute.

SUMMARY OF THE INVENTION

The present invention provides an apparatus and process for effectively placing a uniform gravel pack in a wellbore in fluid communication with a subterranean hydrocarbon-bearing formation. The invention reduces or eliminates substantial bridging, duning or other non-uniformities during placement of the gravel pack while enabling recirculation of an injected carrier fluid back to the wellhead.

The apparatus of the present invention is a staged screen assembly. The assembly is in fluid communication with a wellbore tubing string originating at the wellhead. The assembly extends concentrically through the wellbore down the length of the production zone and forms an annulus adjacent the production zone between the assembly and the wall of the wellbore.

The staged screen assembly comprises a base pipe and a screen which covers a series of ports in the sidewall of the base pipe. The lowermost portion of the base pipe sidewall is provided with an open port which enables initial fluid communication between the exterior and interior of the base pipe. The remainder of the base pipe sidewall above the open port is provided with one or more plugged ports at vertically-spaced intervals. Flow through the plugged ports is blocked by rupture disks.

The process of the present invention is performed by injecting a slurry into the annulus. The slurrycomprises solid particulate material and a carrier fluid. The carrier fluid initially transports the solid to the bottom of the annulus where it accumulates while the carrier fluid leaks off into the base pipe via the open port in the base pipe's sidewall.

As the slurry is continuously injected, the gravel pack builds up from the bottom of the annulus. When the gravel pack reaches a height which covers the open port, the gravel pack impedes the leakoff of carrier fluid from the annulus and the annular pressure increases relative to the pressure in the interior of the base pipe. Eventually the annular pressure reaches the rupture pressure of the lowest rupture disk in the base pipe. The disk consequently ruptures, creating a new port in the base pipe.

The newly-created port reduces the annular pressure and enables the continuously injected carrier fluid to once again leak off unimpeded into the base pipe while the solid continues to pack the annulus. It is apparent that the above described sequence will be repeated with each successive rupture disk until all of the disks in the base pipe have ruptured and the gravel pack has filled the entire annulus adjacent the production zone.

Once the gravel pack is in place, hydrocarbons can be produced from the well. The ports left in the base pipe by blowing out the rupture disks enable hydrocarbon fluids from the formation to pass through the base pipe into the production tubing where the fluids are produced to the surface The gravel pack prevents solid fines, including sand, entrained in the produced fluids from entering the production tubing and causing damage to the tubing and production equipment. The gravel pack additionally prevents the caving of sand behind the casing of cased wellbores during hydrocarbon production and resultant damage to the casing.

DESCRIPTION OF PREFERRED EMBODIMENTS

Figure 1:
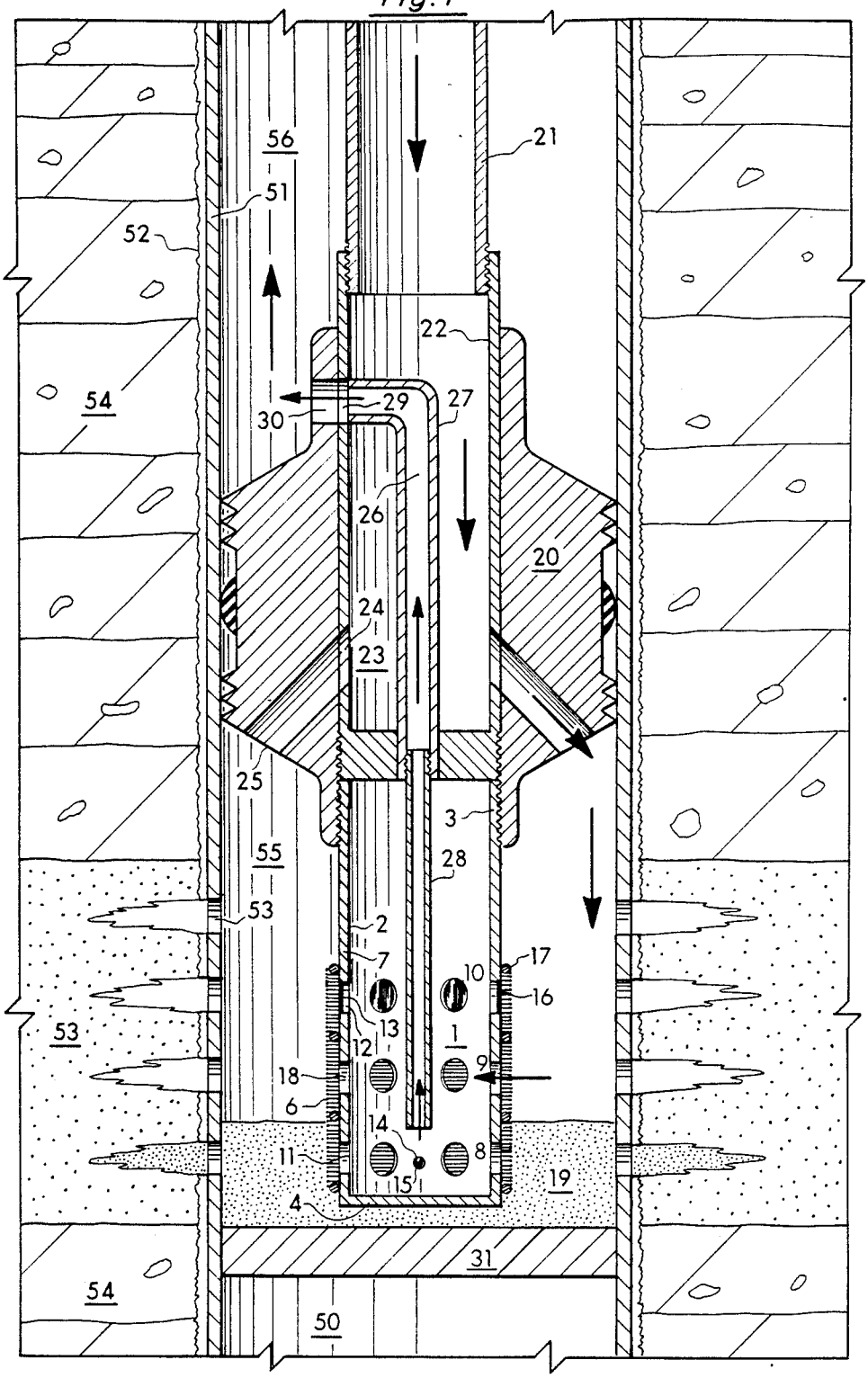
FIG. 1 is a cutaway view of the present apparatus in place during the present circulating gravel packing process in a cased and cemented wellbore which has been perforated.

The present invention is described in greater detail with reference to the Figures. FIG. 1 shows the apparatus of the present invention in place in a wellbore 50. The apparatus is a staged screen assembly 1 having an open tubular structure 2 which operates in concert with a number of other structures described below.

The wellbore 50 containing the staged screen assembly 1 shown in FIG. 1 has a casing 51 which is cemented in place by a cement sheath 52. The cement sheath 52 and casing 51 contain perforations 57 which penetrate into the hydrocarbon production zone 53 of the formation 54. The present invention is likewise applicable to uncased wellbores. Thus, the term "wellbore wall" is used broadly to denote the inserted wellbore casing where the wellbore of interest is cased or to denote the rock wellbore face where the wellbore of interest is uncased.

The assembly 1 is suspended from its upper end 3 concentrically within the wellbore 50 at the depth of the hydrocarbon production zone 53 by means of a conventional ring-shaped or toroidal zone isolation packer 20. The zone isolation packer 20 is fixed against the wellbore wall 51 above the production zone 53 to substantially block fluid flow between the wall 51 and the packer 20. The assembly 1 is positioned to form an annulus 55 in the wellbore between the wellbore wall 51 and the assembly 1 below the zone isolation packer 20. As shown in FIG. 1, the zone isolation packer 20 is fixed relatively near the assembly 1 and production zone 53, but in practice the packer 20 can be as such as 30 meters or more above the assembly 1 and production zone 53.

A work string 21 extends into the wellbore 50 from the wellhead at the surface of the wellbore not shown here to form an annulus 56 between the work string 21 and the wellbore wall 51 above the zone isolation packer 20. The zone isolation packer 20 prevents direct fluid communication between the annuli 55 and 56 above and below it, but a crossover tool 22 runs through the interior of the ring-shaped packer 20 connecting the assembly 1 and work string 21.

The crossover tool 22 provides a first enclosed passageway 23 which fluidly connects the work string 21 and the annulus 55 below the zone isolation packer 20. The passageway 23 runs from the work string 21 through the interior of the packer 20 and opens into a port 24 in the side of the tool 22. The port 24 is aligned with a port 25 in the side of the packer 20 which opens into the annulus 55 below the packer 20.

The crossover tool 22 further provides a second enclosed passageway 26 which fluidly connects the annulus 56 above the zone isolation packer 20 and the interior of the staged screen assembly 1. The passageway 26 comprises an open-ended pipe 27 which runs through the center of the first passageway 23 and opens into the interior of the assembly 1. The passageway 26 may optionally be extended further into the interior of the assembly 1 by attaching a wash pipe 28 thereto. The opposite end of the passageway 26 opens into the annulus 56 above the packer 20 via a port 29 in the side of the crossover tool 22 and a port 30 in the side of the packer 20.

A sump packer 31 may be placed in the wellbore 50 immediately below the staged screen assembly 1. The sump packer 31 reduces the void volume in the wellbore 50 below the assembly 1.

The structure of the staged screen assembly 1 is now described in greater detail. The staged screen assembly 1 comprises a base pipe 2 which is the tubular body of the assembly. The bottom end 4 of the base pipe is closed and the top end 3 is open. A screen 6 wraps the interior or exterior sidewall 7 of the base pipe 2.

The sidewall 7 of the base pipe 2 is segmented into a plurality of vertical stages. Three stages, 8, 9 and 10, are shown here, but any number of multiple stages is possible. Generally, the base pipe sidewall 7 contains as many stages as necessary to effect a uniform gravel pack across the length of the production zone 53. Thus, the number of stages provided in the base pipe sidewall 7 is a function of the length of the production zone 53. In all cases, the base pipe sidewall 7 has at least two stages and preferably three or more stages.

As shown in FIG. 1, the length of the production zone 53 is short relative to the length of the crossover tool 22. However, in practice the production zone can be 10 to 20 meters or more in length with a correspondingly long assembly 1 while the crossover tool is generally a maximum of only 2 or 3 meters in length.

The first or lowest stage 8 of the base pipe sidewall 7 is contiguous with the closed bottom end 4 of the base pipe 2 and has one or more open ports 11 through it which enable fluid communication between the lower annulus 55 below the zone isolation packer 20 and the interior of the base pipe 1. The second or next lowest stage 9 of the sidewall 7 is above and adjacent the first stage 8. If the base pipe 2 comprises more than two stages, each successive stage is above and adjacent the preceding stage in like manner, e.g. stage 10 is above and adjacent stage 9.

Each successive stage after the first stage 8 initially has one or more closed ports 12 in the sidewall 7 of the base pipe 2 which are plugged by openable means such as a rupture disk 13 as shown in stage 10. Each rupture disk 13 is rated for a given pressure differential. When the pressure differential between the interior and exterior of the base pipe 1 surpasses the rated pressure differential of the disk 13, the disk 13 ruptures and subsequently opens the closed port 18 as shown in stage 9 to provide fluid communication between the lower annulus 55 below the zone isolation packer 20 and the interior of the base pipe 1. The operation of the rupture disk 13 is described in greater detail below with regard to the process of the present invention.

A given stage may contain more than one rupture disk, in which case all of the disks in the same stage are preferably spaced at the same vertical depth around the circumference of the base pipe sidewall. Furthermore, all of the disks within a given stage of the base pipe sidewall preferably have the same differential pressure rating, but the differential pressure rating of the disks in successive stages preferably increases from the lower to the upper stages of the base pipe sidewall.

The predetermined differential pressure rating of each disk is selected as a function of the downhole pressures encountered during the gravel packing process and can vary from situation to situation. However, the differential pressure rating of the disks must be below the failure pressure of the continuous base pipe sidewall.

In the three-stage apparatus the differential pressure rating of a rupture disk in the lower stage 9 is typically selected between about 7 kPa to about 1400 kPa. The differential pressure rating of a rupture disk in the upper stage 10 is selected between about 21 kPa and about 2800 kPa. In an apparatus having four or more stages, the differential pressure rating of a rupture disk in a lower stage is typically between about 7 kPa and about 1400 kPa. A rupture disk in a middle stage typically has a differential pressure rating between about 14 kPa and about 2800 kPa. A rupture disk in an upper stage typically has a differential pressure rating between about 21 kPa and about 4100 kPa.

The rupture disks can be provided in the sidewall by a number of ways. For example, a deformation, such as a groove or a depression, can be formed in the continuous material of the base pipe sidewall. This deformation is the rupture disk because it provides a weakened point in the sidewall which will mechanically rupture at a desired preselected pressure differential.

Alternatively, a hole can be bored through the sidewall and plugged with a material which mechanically ruptures at a preselected differential pressure. The differential pressure at which a disk formed in this manner ruptures is generally a function of the disk material's thickness and strength and the strength of the union between the disk and the base pipe sidewall.

The rupture disk can comprise the same material as the base pipe or can comprise a different material, such as different metals or plastics. If the disk is formed from a different material than the base pipe, it is preferably formed from a material which can be welded, threaded or otherwise fixed over the borehole in the sidewall to plug it. In any case, the disk is formed from a material which does not substantially chemically or thermally degrade according to conventional downhole plug degradation means known in the art.

In addition to the rupture disks 13, the base pipe sidewall 7 can further optionally contain additional plugged ports 14, having plugs 15 which are sufficiently strong to remain intact under the pressure of the gravel packing process. The plugs 15 generally have a differential pressure rating at or near the failure pressure of the base pipe.

The additional ports 14 perform no function during the gravel packing process and remain plugged throughout the process. However, upon completion of.,the gravel packing process the plugs 15 may be removed from additional ports 14 by chemical or thermal degradation methods known in the art to provide supplemental hydrocarbon production flow paths into the base pipe 2. The plugs 15 can comprise such materials as waxes, thermoplastic resins or other materials which are susceptible to degradation by known chemical or thermal means.

The base pipe 2 and screen 6 are preferably fabricated from a relatively high-strength material which does not collapse under operating pressures encountered in the wellbore 50 and which is not susceptible to significant degradation in the downhole environment. Exemplary materials for the base pipe 2 and screen 6 include steel and stainless steel.

The screen 6 is placed around the exterior wall of the base pipe 2 as shown here by wrapping one or more lengths of wire around the base pipe 2 in a conventional manner. A small annulus 16 is preferably provided between the screen 6 and the base pipe 2 by means of one or more circular spacers 17 affixed to the base pipe 2. The small annulus 16 formed in this manner typically has a width between about 0.1 cm and about 0.6 cm. The spacers 17 are continuous around the circumference of the base pipe 2 to prevent fluid communication between the stages 8, 9, and 10 across the small annulus 16.

Alternatively the screen 6 can be placed inside the base pipe 2 such that it covers the interior wall of the base pipe 2. The manner of placement and the function of the interior screen is substantially similar to that of an exterior screen.

The gravel packing process of the present invention is shown in progress with reference to FIG. 1. The process is being performed in a vertical wellbore 50 after the wellbore has been cased, cemented and perforated. The staged screen assembly 1 has been placed in the wellbore 50 so that it hangs from the isolation packer 20 and extends the length of the perforated production zone 53. The gravel slurry comprising sized solid particles, such as gravel, and a liquid carrier fluid is being continuously circulated down the work string 21 and through the crossover tool 22 into the lower annulus 55 below the zone isolation packer 20 as shown by the downward arrows. The selection of the specific solid particles and carrier fluid used in the present process and their injection rates is within the purview of one skilled in the art.

As shown in FIG. 1, the gravel pack 19 has already filled the annulus 55 and casing perforations 57 up to the second stage of the base pipe sidewall 7 which restricts the open ports 11 in the first stage 8. The disks 13 which were in the second stage 9 of the base pipe sidewall 7 have ruptured and the carrier fluid is leaking off via the once closed, but now open, ports 18 into the interior of the base pipe 2 as shown by the horizontal arrows. Once inside the base pipe 2, the carrier fluid is recirculated up the wash pipe 28, through the crossover tool 22, into the upper annulus 56 above the zone isolation packer 20 and on its way back to the wellhead not shown here. The direction of flow of the recirculating carrier fluid is shown by the upward arrows. The carrier fluid can be reutilized at the surface for the makeup of additional slurry if desired or discarded.

As the gravel pack 19 continues to progress up beyond the second stage 9, it will sequentially rupture the disks 13 of the successive third stage 10, which enables complete and uniform gravel packing of the lower annulus 55 along the entire production zone 53. Once the annulus 55 is filled with gravel to the upper limit of the production zone 53 which is a point below the zone isolation packer 20, injection of the slurry is stopped.

Figure 2:
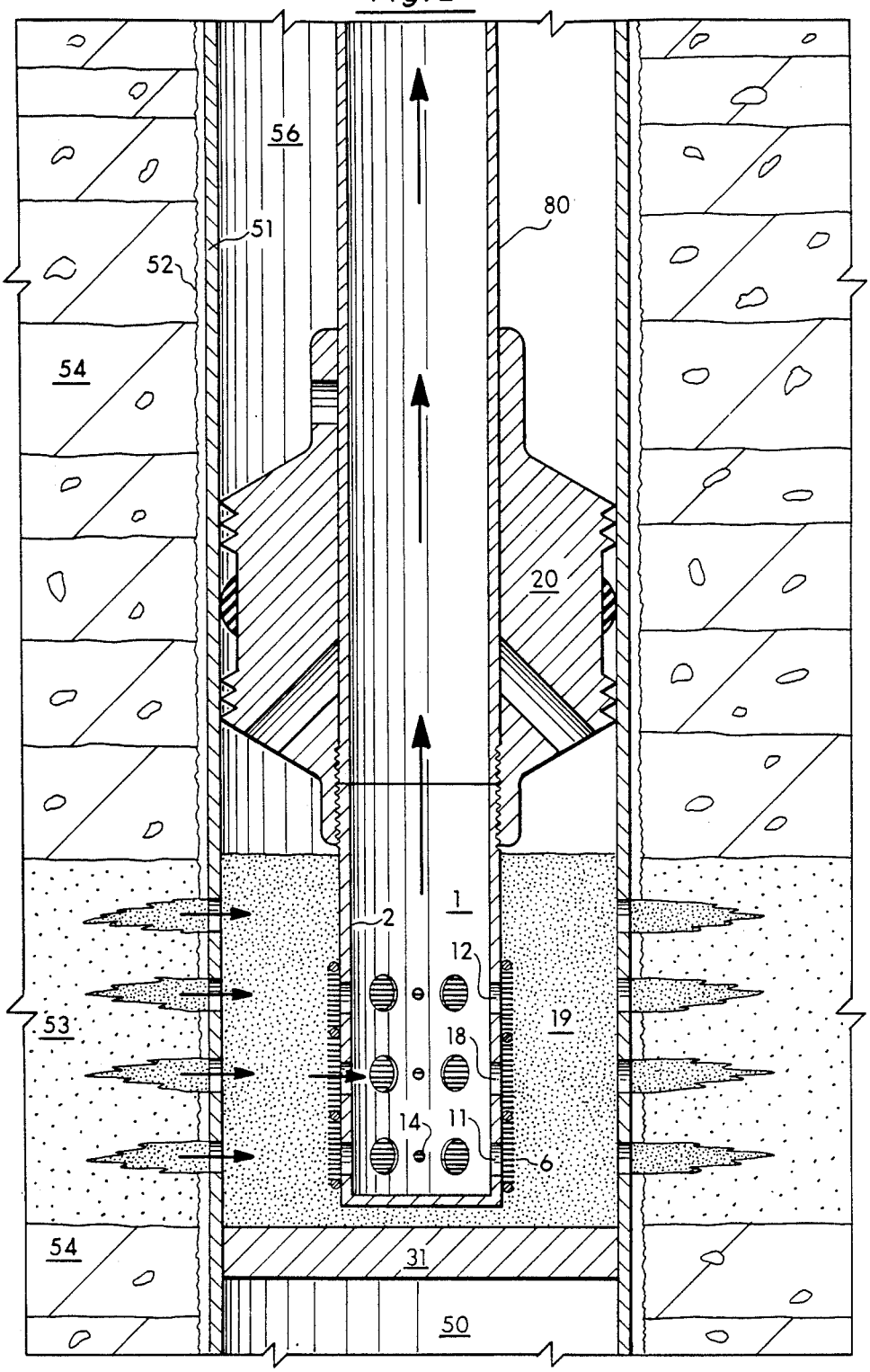
FIG. 2 is a cutaway view of the apparatus showing production of fluids from the reservoir into the production string.

At this point in the process, the work string 21, crossover tool 22 and wash pipe 28 are separated from the staged screen assembly 1 and zone isolation packer 20 and removed from the wellbore 50. A production string 80 as shown in FIG. 2 is joined in fluid communication with the assembly 1 at the zone isolation packer 20.

Hydrocarbon fluids are produced as shown by the arrows from the production zone 53, across the gravel pack 19, into the base pipe 2 and up the production string 80 to the wellhead not shown. The produced hydrocarbon fluids are substantially free of entrained solid fines by the time the fluids are in the base pipe 2.

The present process is especially applicable to highly deviated wellbores because they are particularly susceptible to bridging and duning. Highly deviated wellbores are defined herein as wellbores having a wellbore angle at least 45° from vertical. The process is also applicable to horizontal wellbores which are at an angle 90° from vertical, slightly deviated wellbores which are at an angle greater than 0° but less than 45° from vertical, and vertical wellbores which are at an angle 0° from vertical.

The present invention as described above is used in a cased wellbore. However, it is understood that the invention can also be practiced in substantially the same manner in an open wellbore. Open wellbores are generally encountered in horizontal wellbores. The structural elements of the invention are described herein in vertical relation to one another. The relative vertical positioning of the elements translates likewise to horizontal wellbores by using the end of the wellbore as the reference point.

It is understood that FIGS. 1 and 2 embody the inventive features of the present apparatus and process. Further structural features which are not shown therein, but known to one of ordinary skill in the art, may be added to the structure shown in the figures and fall within the scope of the invention. Alternative configurations of the structural features shown in the figures are also possible which fall within the scope of the present invention.

The following example illustrates the apparatus and process of the present invention. The example is not to be construed as limiting the scope of the invention.

EXAMPLE

A wellbore is drilled to a depth of 3000 meters into a subterranean hydrocarbon-bearing formation comprising unconsolidated sandstone. The wellbore penetrates a hydrocarbon production zone which begins at a depth of 2990 meters and extends downward 10 meters from that depth. The wellbore is cased with a 24.45 centimeter diameter steel casing and cemented. The casing is perforated at 7.62 centimeter intervals.

A sump packer is placed in the cased wellbore at a depth of 3000 meters. A zone isolation packer is placed in the wellbore above the production zone at a depth of 2970 meters. The staged screen assembly of the present invention is hung from the zone isolation packer into the wellbore adjacent the production zone. A crossover tool and work string are placed in the wellbore above the assembly to enable operation of the process of the present invention.

The assembly has a base pipe which is 13.97 centimeters in diameter. The base pipe is made of steel. The base pipe is divided into 21 stages. The lowest stage has 8 open ports which are all at the same vertical depth and which are spaced around the circumference of the base pipe. The diameter of each open port is 1.3 centimeters.

The remaining stages contain closed ports 1.3 centimeters in diameter which are plugged with rupture disks. The rupture disks are made of steel and are welded across the closed ports. Each of the 20 stages of the base pipe above the lowest stage contains 8 closed ports which are all at the same vertical depth and which are spaced around the circumference of the base pipe.

The pressure rating of the rupture disks in the base pipe stage immediately above the lowest stage containing the open ports is 207 kPa. The pressure rating of the rupture disks in the next lowest stage is 414 kPa and the pressure rating in the stage immediately above that stage is 621 kPa and so on up to 4137 kPa at the highest stage.

The base pipe has a screen wrapped around its outer surface covering all of the stages. The screen is a stainless steel wire having a trapezoidal shape which is 0.25 centimeters at its base. The diameter of the base pipe with the screen wrapping around it is 15.24 centimeters.

A gravel packing slurry comprising a 40 to 60 mesh sand in an aqueous polymer solution carrier fluid having a polymer concentration of 7500 ppm is injected into the work string at a rate of 318 liters per minute. The slurry passes through the work string and crossover tool into the wellbore annulus adjacent the hydrocarbon production zone. The sand in the slurry builds up on the sump packer while the carrier fluid passes through the screen and open port of the assembly, up through the crossover tool and back to the wellhead via the wellbore annulus adjacent the work string.

As the gravel pack builds in the annulus alongside the stage screen assembly, the rupture disks blow out sequentially at the rated pressures according to the manner of the present invention. Injection of the slurry is terminated when the gravel pack reaches a depth in the annulus of 2975 meters from the surface.

Thereafter the work string and crossover tool are removed from the wellbore and a production string is placed in the wellbore in fluid communication with the staged screen assembly. Hydrocarbons are produced from the production zone to the wellhead via the staged screen assembly and production string. The produced hydrocarbons are substantially free of unconsolidated solid particles from the formation.

We claim:

1. An apparatus positioned in a wellbore for placing a gravel pack in an annulus of the wellbore, the apparatus comprising:

(a) an isolation means having an inner and an outer surface for isolating the wellbore annulus above said isolation means from the wellbore annulus below said isolation means, said outer surface of said isolation means sealably abutting a wall of the wellbore;

(b) a tubular means having an inner and an outer surface for supporting the gravel pack in the wellbore annulus below said isolation means, said outer surface of said tubular means sealably abutting said inner surface of said isolation means and a substantial portion of said tubular means extending below said isolation means, said substantial portion having a first port therein providing fluid communication between the exterior and the interior of said tubular means and being provided with a first rupture disk therein which is positioned above said first port, said first rupture disk rupturing to provide for fluid communication through said substantial portion when a greater pressure on said outer surface of said tubular means relative to a pressure on said inner surface of said tubular means creates a predetermined pressure differential during a gravel packing process; and (c) a means substantial covering said first port and said first rupture disk for filtering a gravel packing slurry to allow a carrier fluid to pass through said filter means, but to block gravel from passing through said filter means.

2. The apparatus of claim 1 further comprising:

a means for feeding the gravel packing slurry from a surface wellhead to the wellbore annulus below said isolation means; and a means for recirculating the carrier fluid from the interior of said tubular means to the surface wellhead.

3. The apparatus of claim 1 further comprising at least one additional rupture disk in said substantial portion, each said additional rupture disk being successively and vertically spaced in said tubular means above said first rupture disk.

4. The apparatus of claim 1 wherein the wellbore wall is a perforated wellbore casing providing fluid communication between a hydrocarbon-bearing subterranean formation and the wellbore annulus below said isolation means.

5. An apparatus for placing a gravel pack in a wellbore comprising:

(a) a zone isolation packer;

(b) a walled base pipe connectively extending below said zone isolation packer;

(c) an open port in said wall of said base pipe, said open port providing fluid communication between the exterior of said base pipe below said zone isolation packer and the interior of said base pipe;

(d) a closed port in said wall of said base pipe above said open port, said closed port being plugged by a disk and capable of providing fluid communication between the exterior of said base pipe below said zone isolation packer and the interior of said base pipe by automatically opening when the base pipe exterior and interior experience a predetermined pressure differential during a circulating gravel packing process which is sufficient to rupture said disk;

(e) a filter substantially covering said open port and said closed port; and (f) a crossover tool providing a first fluid passageway between an annulus between a work string and the wall of the wellbore and the interior of said base pipe and further providing a second fluid passageway between the work string and the exterior of said base pipe below said zone isolation packer, said second fluid passageway being isolated from said first fluid passageway.

6. The apparatus of claim 5 wherein said filter is a screen wrapped around at least a portion of the outer surface of said base pipe.

7. The apparatus of claim 5 wherein said filter is a screen wrapped around at least a portion of the inner surface of said base pipe.

8. The apparatus of claim 5 wherein said wall of said base pipe contains a plurality of said closed ports successively spaced at vertical intervals above said open port.

9. The apparatus of claim 5 further comprising a wash pipe at a lower end of said first fluid passageway further extending into the interior of said base pipe.

10. A process for placing a gravel pack in a wellbore penetrating a subterranean hydrocarbon-bearing formation from a surface wellhead, the process comprising:

(a) placing a zone isolation packer having an axial void against a wall of the wellbore above a hydrocarbon production zone in the hydrocarbon-bearing formation to block fluid flow between the wellbore wall and the packer;

(b) placing a tubular member in the axial void of the packer and extending the tubular member in the wellbore below the packer to form an annulus between the wall of the wellbore and the tubular member below the packer;

(c) continuously injecting a gravel packing slurry comprising solid particles and a carrier fluid from the surface wellhead through a first fluid passageway in fluid communication with the wellhead and the wellbore annulus below the packer;

(d) circulating the carrier fluid from the wellbore annulus below the packer through an open port in the tubular member back to the surface wellhead via a second fluid passageway in fluid communication with the wellhead and the interior of the tubular member;

(e) building up the solid particles in the wellbore annulus below the packer by blocking passage of the solid particles through the open port back to the surface wellhead with a filter covering the open port;

(f) restricting circulation of the carrier fluid through the open port by building up the solid particles across the filter covering the open port to create a differential between a greater pressure in the annulus below the packer and a lesser pressure in the interior of the tubular member;

(g) rupturing a rupture disk provided in the tubular member above the open port by means of the pressure differential thereby creating a new port and;

(h) circulating the carrier fluid from the wellbore annulus below the packer through the new port in the tubular means back to the surface wellhead via the second fluid passageway.

11. The process of claim 10 wherein the tubular member has a plurality of said rupture disks and two or more of said rupture disks are successively spaced at vertical intervals in the tubular member above the open port.

12. The process of claim 11 wherein each of the two or more successively spaced rupture disks has a differential pressure rating substantially increasing with each increasing vertical interval.

13. The process of claim 10 further comprising terminating injection of the gravel packing slurry when the solid particles build up to a point in the wellbore annulus below said packer sufficient to fill the portion of the annulus adjacent the hydrocarbon production zone with solid particles.

14. The process of claim 10 further comprising removing the first and second fluid passageways from the wellbore after terminating injection of the gravel packing slurry and placing a hydrocarbon production tubing in the wellbore in fluid communication with the wellhead and the interior of the tubular member.

15. The process of claim 14 hydrocarbon fluids are produced from the hydrocarbon production zone of the subterranean hydrocarbon-bearing formation, across the gravel pack, into the interior of the tubular member, and up the production string to the wellhead.

16. The process of claim 15 wherein said wellbore wall is a wellbore casing and the casing has perforations to provide fluid communication between the hydrocarbon production zone of subterranean hydrocarbon-bearing formation and the interior of the tubular member.

17. The process of claim 10 wherein the wellbore wall is a wellbore casing.

18. The process of claim 10 wherein the wellbore wall is a wellbore face.

19. The process of claim 11 further comprising repeating steps (e) through (h) for each of said plurality of said rupture disks and the next successive rupture disk until all of said rupture disks are ruptured.

* * * * *

UNITED STATES PATENT AND TRADEMARK OFFICE

CERTIFICATE OF CORRECTION

PATENT NO. : 4,932,474

DATED : June 12, 1990

INVENTOR(S) : Donald E. Schroeder, Jr., et al.

It is certified that error appears in the above-identified patent and that said Letters Patent is hereby corrected as shown below:

Col. 10, line 60: After "claim 14" insert "wherein".

Signed and Sealed this

Sixteenth Day of July, 1991

*Attest:*

HARRY F. MANBECK, JR.

*Attesting Officer*

*Commissioner of Patents and Trademarks*